US008455776B2

(12) United States Patent
Masuda et al.

(10) Patent No.: US 8,455,776 B2
(45) Date of Patent: Jun. 4, 2013

(54) PUSH SWITCH

(75) Inventors: Masahiro Masuda, Okayama (JP); Yasunori Yanai, Okayama (JP); Yoshikazu Yagi, Okayama (JP)

(73) Assignee: Panasonic Corporation, Osaka (JP)

( * ) Notice: Subject to any disclaimer, the term of this patent is extended or adjusted under 35 U.S.C. 154(b) by 185 days.

(21) Appl. No.: 13/032,062

(22) Filed: Feb. 22, 2011

(65) Prior Publication Data

US 2011/0240446 A1 Oct. 6, 2011

(30) Foreign Application Priority Data

Mar. 30, 2010 (JP) ..... 2010-078353

(51) Int. Cl.
*H01H 1/64* (2006.01)

(52) U.S. Cl.
USPC ..... 200/293

(58) Field of Classification Search
USPC ..... 200/406, 16 R–16 D, 292–296, 303, 200/547, 548, 536
See application file for complete search history.

(56) References Cited

U.S. PATENT DOCUMENTS

| | | | | |
|---|---|---|---|---|
| 4,913,285 | A * | 4/1990 | Tsutsumi et al. | 200/306 |
| 4,987,278 | A * | 1/1991 | Tsutsumi | 200/294 |
| 2008/0035462 | A1 * | 2/2008 | Yanai et al. | 200/406 |
| 2009/0308725 | A1 | 12/2009 | Yanai et al. | |

FOREIGN PATENT DOCUMENTS

| | | |
|---|---|---|
| CN | 101604589 | 12/2009 |
| JP | 5-144345 | 6/1993 |
| JP | 2003-217395 | 7/2003 |
| JP | 2006-210195 | 8/2006 |
| JP | 2009-231062 | 10/2009 |

* cited by examiner

*Primary Examiner* — Edwin A. Leon
(74) *Attorney, Agent, or Firm* — Panasonic Patent Center

(57) ABSTRACT

A push switch includes a switch section for carrying out electric connection by pushing, a switch case having a groove portion on a side surface thereof and accommodating the switch section, and a terminal produced integrally with the switch case and led out from a side surface of the switch case. The groove portion extends from a vicinity of the terminal.

7 Claims, 11 Drawing Sheets

PUSH SWITCH

BACKGROUND OF THE INVENTION

1. Field of the Invention

The present invention relates to a surface mount type push switch used in input operation sections of various electronic apparatuses.

2. Background Art

Recently, various electronic apparatuses typified by mobile phones have been reduced in size and thickness. Accordingly, surface mount type push switches used in input operation sections of such electronic apparatuses are also thinned. Specifically, a push switch having a configuration in which a switch main body is inserted in a cut-away portion provided in a printed circuit board so as to suppress protrusion from the surface of the printed circuit board is used.

A conventional push switch is described with reference to FIGS. 9 to 13. FIG. 9 is an outline view of a conventional push switch seen obliquely from above. FIG. 10 is an exploded perspective view of this push switch. FIG. 11 is an outline view of this push switch seen obliquely from below. FIG. 12 is a sectional view of this push switch. FIG. 13 is a sectional view showing a state in which this push switch operates.

Switch case 1 has a substantially rectangular shape having a concave portion that opens upward in the center part, and corner protruding portions 1A at the four corners. Furthermore, switch case 1 has center contact 2 in the center of the inner bottom surface of the concave portion and outer contacts 3 in two positions symmetrical with respect to center contact 2 (FIG. 10 shows only one outer contact 3). Terminals 2A and 3A are produced integrally with switch case 1 by insert molding. Terminal 2A is connected to center contact 2, and terminal 3A is connected to outer contact 3. Terminals 2A and 3A are led out horizontally outward from the positions at middle height on the right and left side surfaces of switch case 1.

Movable contact 4 is made of an elastic thin metal plate having an upward curved dome shape, and contained in a concave portion of switch case 1. The bottom end of the outer periphery of movable contact 4 is placed on outer contacts 3 located in two positions, and the lower surface of a dome-shaped center part of movable contact 4 faces center contact 2 with a predetermined gap.

Protective sheet 5 made of an insulating film is attached from the upper side of movable contact 4 so as to cover the concave portion of switch case 1, and movable contact 4 is contained in the concave portion. An adhesive agent (not shown) is applied to the lower surface of protective sheet 5.

Operation body 6 includes operation part 6A protruding to the front side of switch case 1, elastic rod-shaped pushing part 6B in the rear side of operation part 6A, and frame part 6C surrounding pushing part 6B. Four corner protruding portions 1A of switch case 1 guide operation body 6, so that operation body 6 can move backward and forward on the top surface of protective sheet 5.

Substantially rectangular cover 7 has tilting part 7A, which is bent obliquely downward, in the center part thereof. Cover 7 is combined with switch case 1 from the upper side of operation body 6. Locking parts 7B formed by being bent downward from four corners of cover 7 are locked and fixed to locking protrusions 1B provided on corner protruding portions 1A of switch case 1.

Pressing part 6B has a spherical tip and is brought into contact with tilting part 7A of cover 7. Pressing part 6B is located above the center part of movable contact 4 via protective sheet 5.

A conventional push switch is configured as mentioned above. Next, an operation of the push switch is described.

In FIG. 12, when a pushing force is applied to operation part 6A in a direction of arrow 60, a tip of pushing part 6B moves on protective sheet 5 while it bends obliquely downward along tilting part 7A of cover 7. According to the movement, pushing part 6B pushes the dome-shaped center part of movable contact 4 via protective sheet 5. When the pushing force is beyond a predetermined pushing force, as shown in FIG. 13, the center part of movable contact 4 is elastically deformed in a downward convex form with a click feeling, and is brought into contact with center contact 2. As a result, outer contacts 3 and center contact 2 make an electric connection with each other via movable contact 4, thus allowing terminal 2A and terminal 3A to be electrically connected to each other. Then, frame part 6C of operation body 6 is brought into contact with corner protruding portion 1A located in the rear side of switch case 1, and the backward movement of operation body 6 is restricted.

When the pushing force applied to operation part 6A is released, the center part of movable contact 4 elastically returns back to its original upward curved shape by an elastic force of itself with a click feeling, and the center part of movable contact 4 is separated from center contact 2. A returning force of movable contact 4 and an elastic force of pushing part 6B itself of operation body 6 allow the tip of pushing part 6B to move obliquely upward along tilting part 7A of cover 7. Then, operation body 6 is returned to the front side, thus electrically disconnecting between terminal 2A and terminal 3A.

The following is a description of a state in which a push switch is mounted on a printed circuit board of an electronic apparatus. FIG. 14 is an outline view showing a state in which the conventional push switch is mounted on a printed circuit board.

A plurality of lands 53 are provided on the top surface of printed circuit board 51 corresponding to the positions to which terminals 2A and 3A of the push switch are soldered. Wiring board 51 is provided with U-shaped cut-away portion 52. The width dimension and the depth dimension of U-shaped cut-away portion 52 are slightly larger than those of switch case 1 of the push switch.

In switch case 1, a part that is lower than the positions from which terminals 2A and 3A are led out is inserted in cut-away portion 52. Terminals 2A and 3A are placed on corresponding lands 53 and mounted by soldering. Operation part 6A of operation body 6 protrudes to the front side from the end part of printed circuit board 51, and it can be pushed in the direction parallel to the top surface of printed circuit board 51.

However, in the above-mentioned conventional push switch, when the push switch is mounted by soldering on printed circuit board 51, flux may spread from terminals 2A and 3A to the surface of switch case 1. When the flux reaches the ridge line of the external corner portion of switch case 1, it may spread along the ridge line and reach operation body 6, which may hinder the operation of the switch.

SUMMARY OF THE INVENTION

A push switch of the present invention includes a switch section for carrying out electric connection by pushing, a switch case having a groove portion on a side surface thereof and accommodating the switch section, and a terminal produced integrally with the switch case and led out from a side surface of the switch case. The groove portion extends from a vicinity of the terminal.

In the push switch of the present invention, at the time of solder mounting, flux traveling from the terminal to the switch case is led by the groove portion, so that the flux does not travel to an operation body. Therefore, a push switch that does not hinder the operation of the switch can be provided.

DETAILED DESCRIPTION OF THE INVENTION

Figure 1:
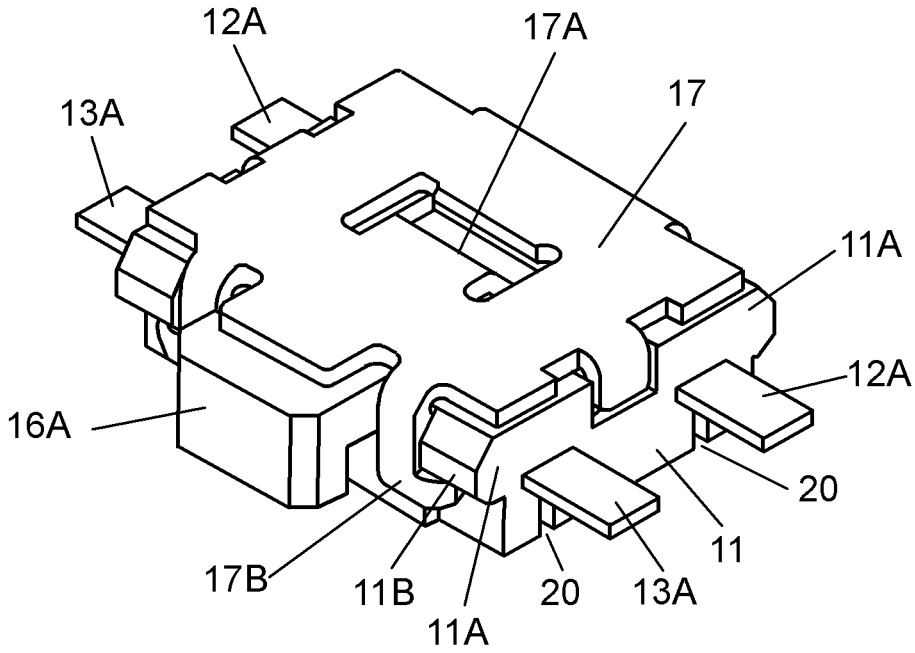
FIG. 1 is an outline view of a push switch seen obliquely from above in accordance with an embodiment of the present invention.
Figure 2:
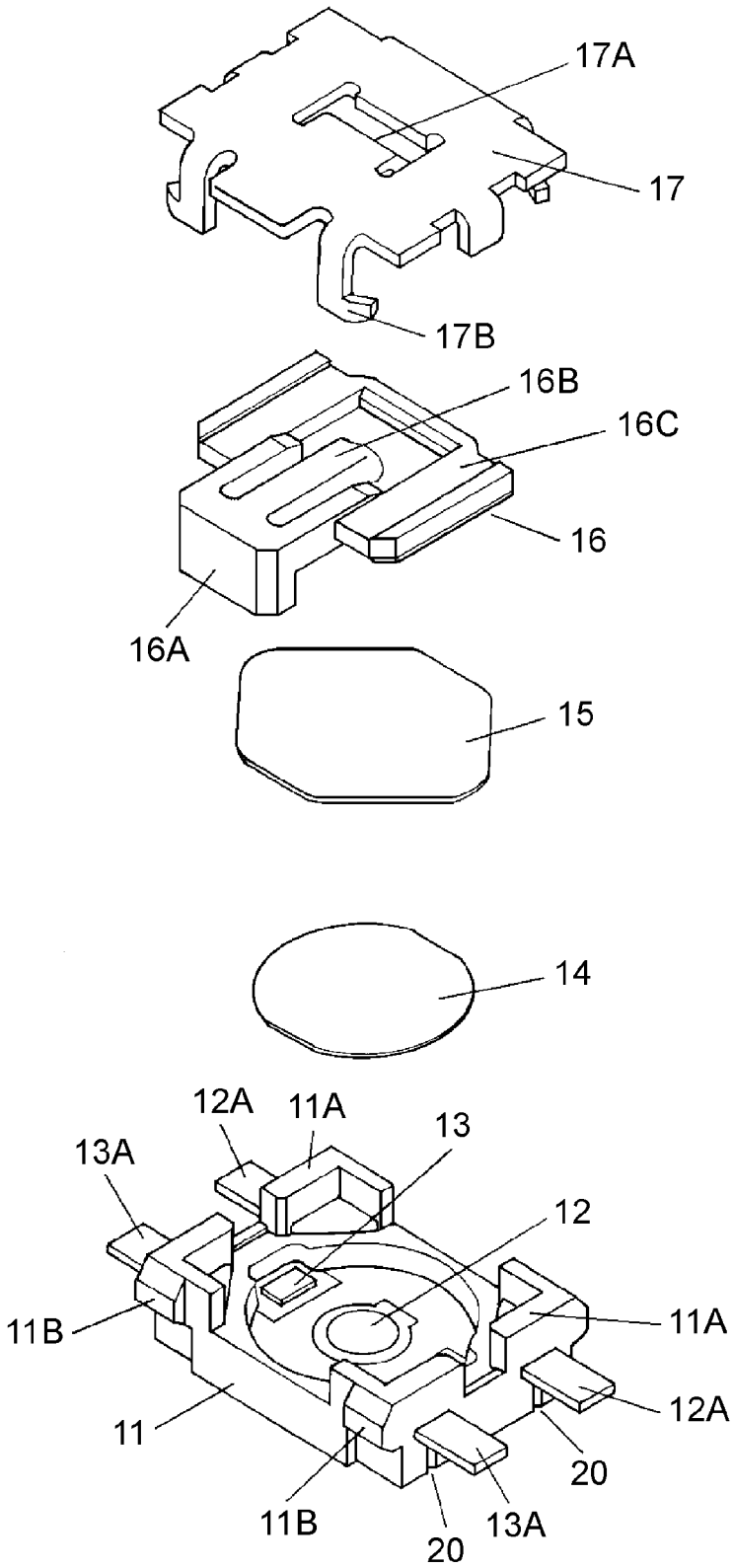
FIG. 2 is an exploded perspective view of the push switch in accordance with an embodiment of the present invention.
Figure 3:
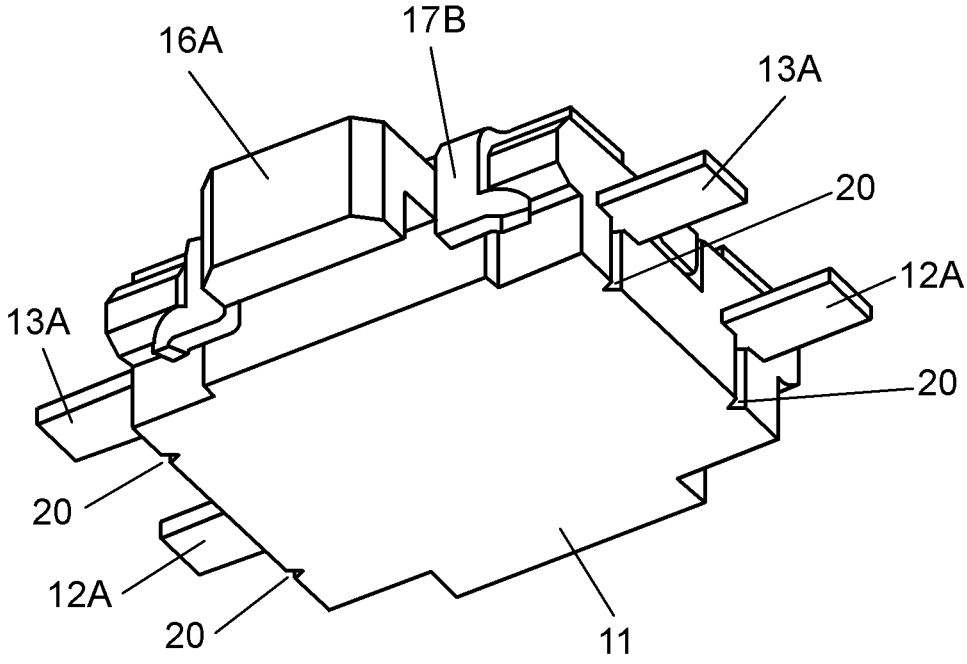
FIG. 3 is an outline view of the push switch seen obliquely from below in accordance with an embodiment of the present invention.
Figure 4:
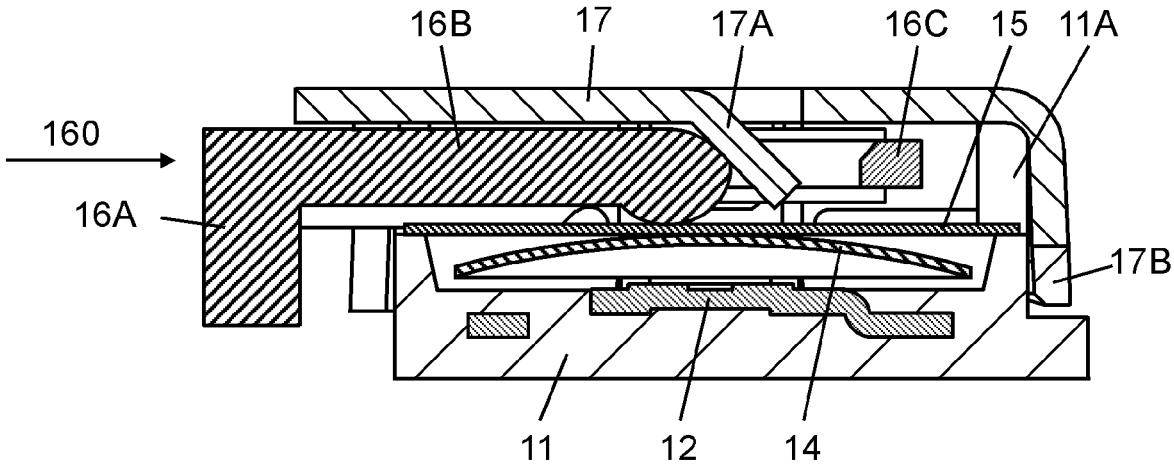
FIG. 4 is a sectional view of the push switch in accordance with an embodiment of the present invention.

Hereinafter, an embodiment of the present invention is described with reference to FIGS. 1 to 8. FIG. 1 is an outline view of a push switch seen obliquely from above in accordance with an embodiment of the present invention. FIG. 2 is an exploded perspective view of the push switch in accordance with an embodiment of the present invention. FIG. 3 is an outline view of the push switch seen obliquely from below in accordance with an embodiment of the present invention. FIG. 4 is a sectional view of the push switch in accordance with an embodiment of the present invention.

Figure 5:
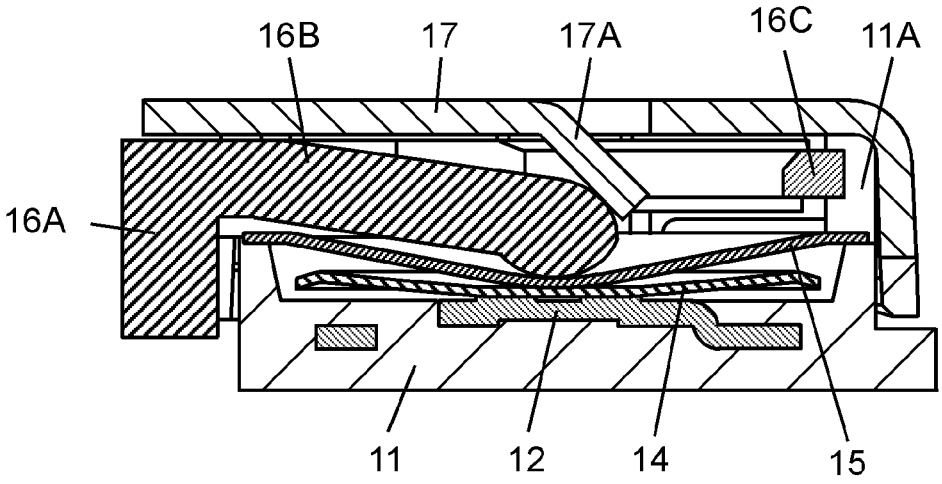
FIG. 5 is a sectional view showing a state in which the push switch operates in accordance with an embodiment of the present invention.

FIG. 5 is a sectional view showing a state in which the push switch operates in accordance with an embodiment of the present invention. The push switch of the present invention includes a switch section for carrying out electric connection by pushing, switch case 11 having groove portion 20 on the side surface thereof, and terminals 12A and 13A produced integrally with switch case 11 and led out from the side surface of switch case 11. Groove portion 20 extends from the vicinity of the terminal. The switch section includes operation body 16, movable contact 14, center contact 12 and outer contact 13.

Switch case 11 has a substantially rectangular shape having a concave portion (an opening portion) that opens upward in the center part, and corner protruding portions 11A at the four corners. Furthermore, switch case 11 has center contact 12 on the inner bottom surface of the concave portion and outer contacts 13 in two positions symmetrical with respect to center contact 12 (FIG. 2 shows only one outer contact 13). Terminals 12A and 13A are produced integrally with switch case 11 by insert molding. Terminal 12A is connected to center contact 12, and terminal 13A is connected to outer contact 13. Terminals 12A and 13A are led out horizontally outward from the positions at middle height on the right and left side surfaces of switch case 11.

Movable contact 14 is made of an elastic thin metal plate having an upward curved dome shape. The bottom end of the outer periphery of mobile contact 14 is placed on outer contacts 13 of switch case 11. The lower surface of the dome-shaped center part of movable contact 14 faces center contact 12 with a predetermined gap.

Protective sheet 15 made of an insulating film is attached from the upper side of movable contact 14 so as to cover the concave portion of switch case 11, and movable contact 14 is contained in the concave portion. An adhesive agent (not shown) is applied to the lower surface of protective sheet 15.

Operation body 16 includes operation part 16A protruding to the front side of switch case 11, elastic rod-shaped pushing part 16B in the rear side of operation part 6A, and frame part 16C surrounding pushing part 16B. Four corner protruding portions 11A of switch case 11 guide operation body 16, so that operation body 16 can move backward and forward on the top surface of protective sheet 15.

Substantially rectangular cover 17 made of a metal thin plate has tilting part 17A, which is bent obliquely downward, in the center part thereof. Cover 17 is combined with switch case 11 from the upper side of operation body 16. Locking parts 17B are locked and fixed to locking protrusions 11B of corner protruding portions 11A of switch case 11, and the tip of pushing part 16B is brought into contact with tilting part 17A.

In this embodiment, as shown in FIGS. 1 to 3, on the right and left side surfaces of switch case 11, groove portions 20 extending in the direction perpendicular to the surfaces of terminals 12A and 13A are provided. Groove portions 20 are respectively provided linearly downward from the positions that are brought into contact with the lower surfaces of terminals 12A and 13A.

A push switch is configured as mentioned above. Next, an operation of the push switch is described.

In FIG. 4, when a pushing force is applied to operation part 16A in a direction of arrow 160, a tip of pushing part 16B moves on protective sheet 15 while it bends obliquely downward along tilting part 17A of cover 17. According to the movement, pushing part 16B pushes the dome-shaped center part of movable contact 14 via protective sheet 15. When the pushing force is beyond a predetermined pushing force, as shown in FIG. 5, the center part of movable contact 14 is elastically deformed in a downward convex form with a click feeling, and is brought into contact with center contact 12. As a result, outer contacts 13 and center contact 12 make an electric connection with each other via movable contact 14, thus allowing terminal 12A and terminal 13A to be electrically connected to each other. Then, frame part 16C of operation body 16 is brought into contact with corner protruding portion 11A located in the rear side of switch case 11, and the backward movement of operation body 16 is restricted.

When the pushing force applied to operation part 16A is released, the center part of movable contact 14 elastically returns back to its original upward curved shape by an elastic force of itself with a click feeling, and the center part of movable contact 14 is separated from center contact 12. A returning force of movable contact 14 and an elastic force of pushing part 16B itself of operation body 16 allow the tip of pushing part 16B to move obliquely upward along tilting part 17A of cover 17. Then, operation body 16 is returned to the front side, thus electrically disconnecting between terminal 12A and terminal 13A.

Figure 6:
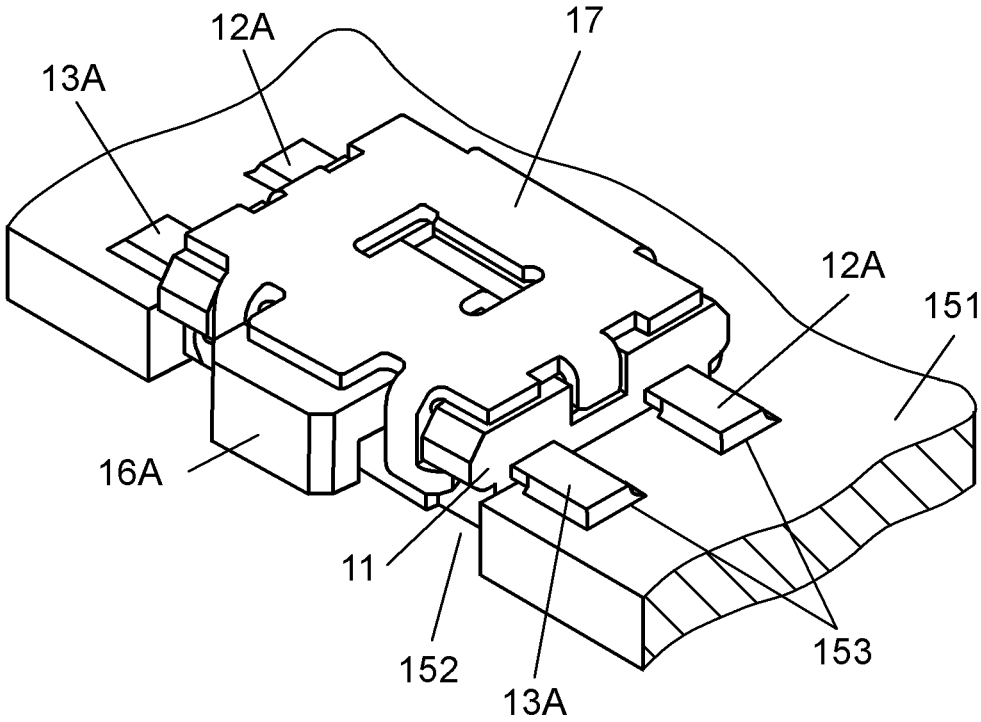
FIG. 6 is an outline view showing a state in which the push switch is mounted on a printed circuit board in accordance with an embodiment of the present invention.

The following is a description of a state in which a push switch in accordance with this embodiment is mounted on a printed circuit board of an electronic apparatus. FIG. 6 is an outline view showing a state in which the push switch is mounted on a printed circuit board in accordance with an embodiment of the present invention.

A plurality of lands 153 are provided on the top surface of printed circuit board 151 corresponding to the positions to which terminals 12A and 13A of the push switch are soldered. Wiring board 151 is provided with U-shaped cut-away portion 152. The width dimension and the depth dimension of U-shaped cut-away portion 152 are slightly larger than those of switch case 11 of the push switch.

In FIG. 6, operation part 16A protrudes from the edge portion of printed circuit board 151. In switch case 11, a part that is lower than the positions from which terminals 12A and 13A are led out is inserted in cut-away portion 152. Terminals 12A and 13A have surfaces that are to be soldered to printed circuit board 151. Terminals 12A and 13A are placed on the corresponding lands 153, and mounted by soldering.

Figure 7:
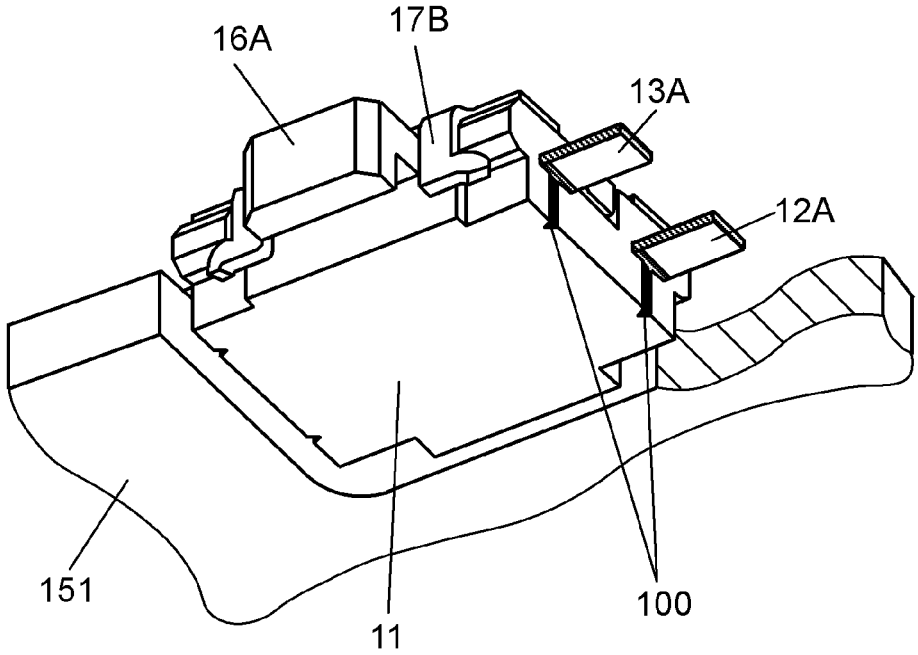
FIG. 7 is a view showing a state in which flux travels on a switch case, which is shown with the printed circuit board partially cut away.

FIG. 7 is a view showing a state in which flux travels on the switch case, which is shown with the printed circuit board partially cut away. When solder mounting is carried out, flux may be generated from cream solder that is intervened between the lower surfaces of terminals 12A and 13A and lands 153. Flux 100 wets the side surfaces of terminals 12A and 13A and then reaches groove portion 20 provided from each of the lower surface sides of terminals 12A and 13A of switch case 11 to the lower side. Then, flux 100, from its nature, is led by groove portion 20 and reaches the tip (the end) of groove portion 20. With this configuration, excessive flux 100 does not spread on the surface of switch case 11, and does not hinder the back and forth movement of operation body 16.

It is preferable that groove portions 20 are provided to the lower surfaces of terminals 12A and 13A such that they extend in the direction away from the opening of switch case 11 because the direction in which flux is led is a direction away from the opening side.

Furthermore, groove portion 20 of switch case 11 may not be brought into contact with each of the lower surfaces of terminals 12A and 13A, and may be provided in the position near (in the vicinity of) the lower surfaces of terminals 12A and 13A. Furthermore, the number of groove portion 20 may not necessarily be limited to one. Furthermore, it is preferable that groove portion 20 extends in the direction perpendicular to the surfaces of terminals 12A and 13A, but the direction is not necessarily limited to the perpendicular direction.

Furthermore, in this embodiment, linear groove portion 20 is formed. However, groove portion 20 may be not linear but curved.

Figure 8:
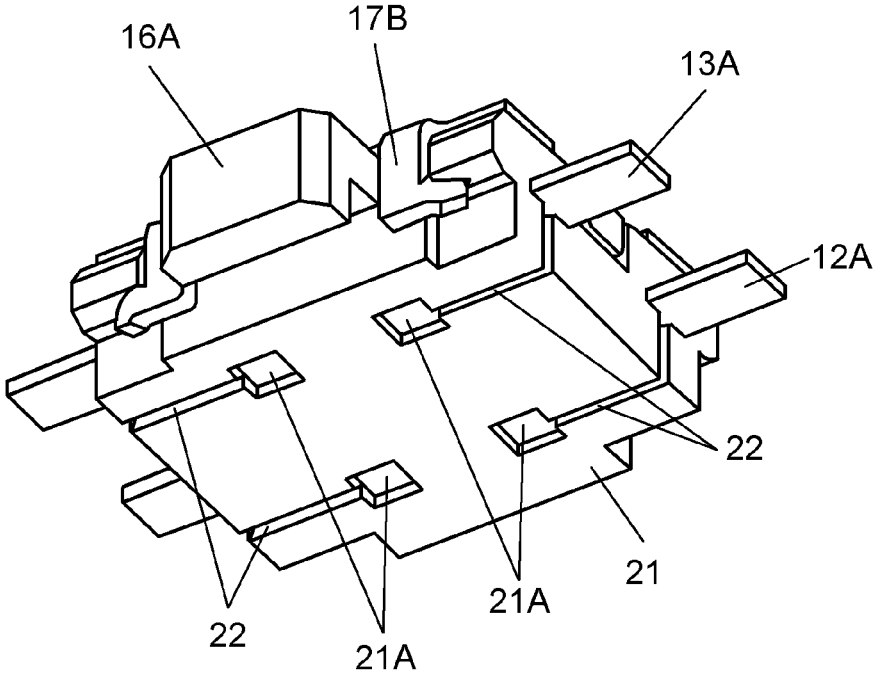
FIG. 8 is an outline view of another push switch seen obliquely from below in accordance with an embodiment of the present invention.
Figure 9:
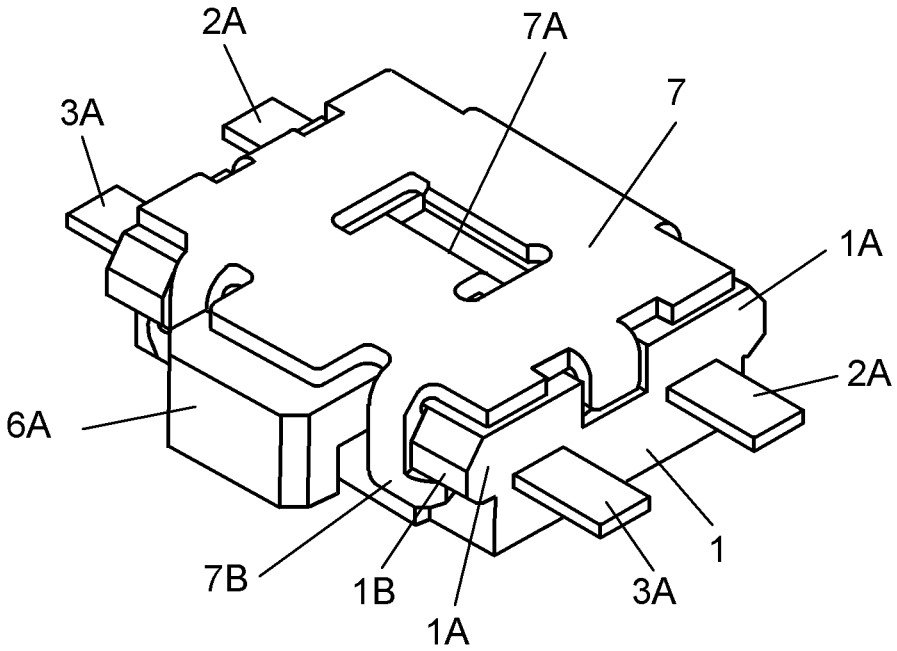
FIG. 9 PRIOR ART
FIG. 9 is an outline view of a conventional push switch seen obliquely from above.
Figure 10:
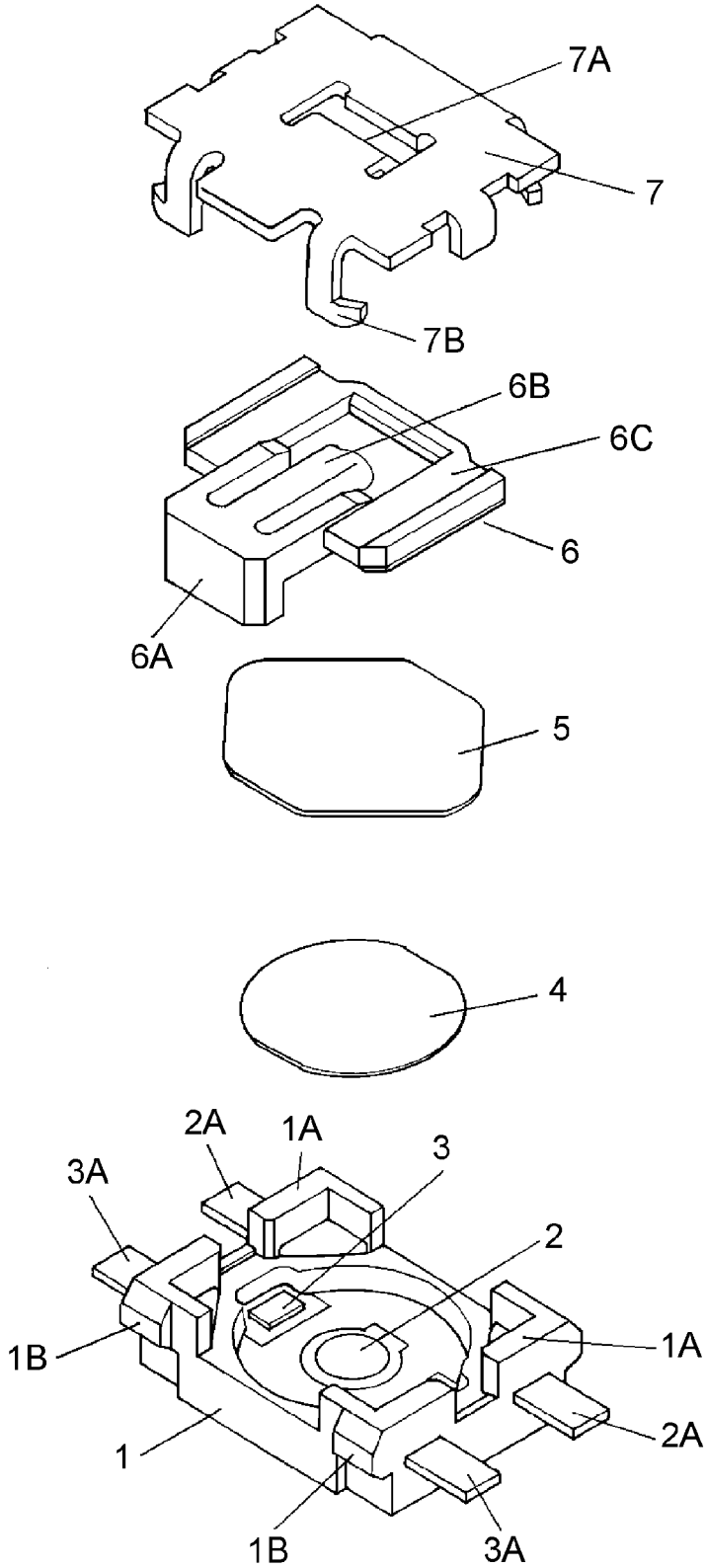
FIG. 10 PRIOR ART
FIG. 10 is an exploded perspective view of the conventional push switch.
Figure 11:
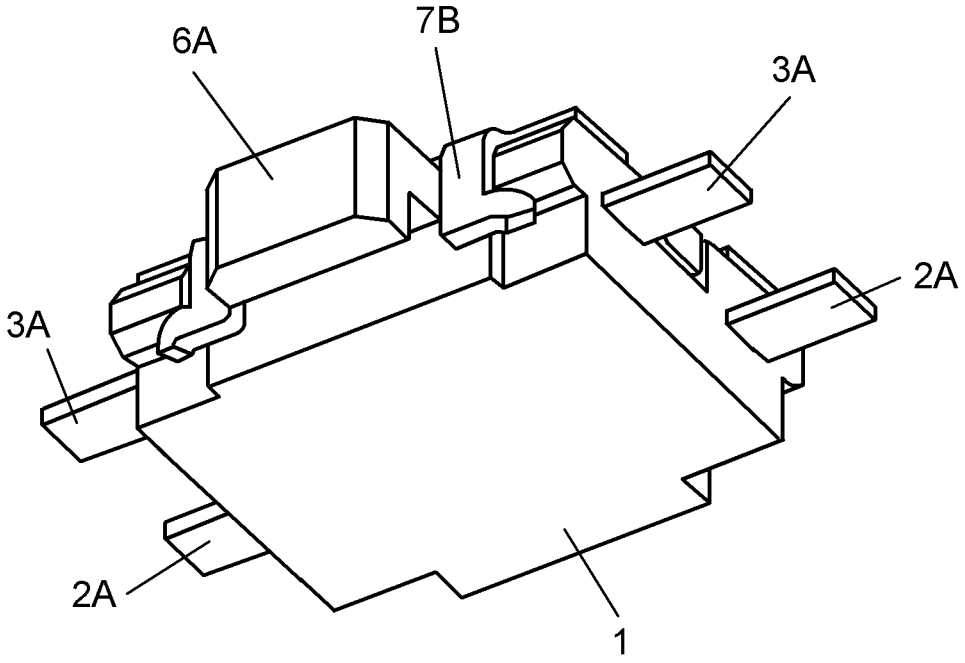
FIG. 11 PRIOR ART
FIG. 11 is an outline view of the conventional push switch seen obliquely from below.
Figure 12:
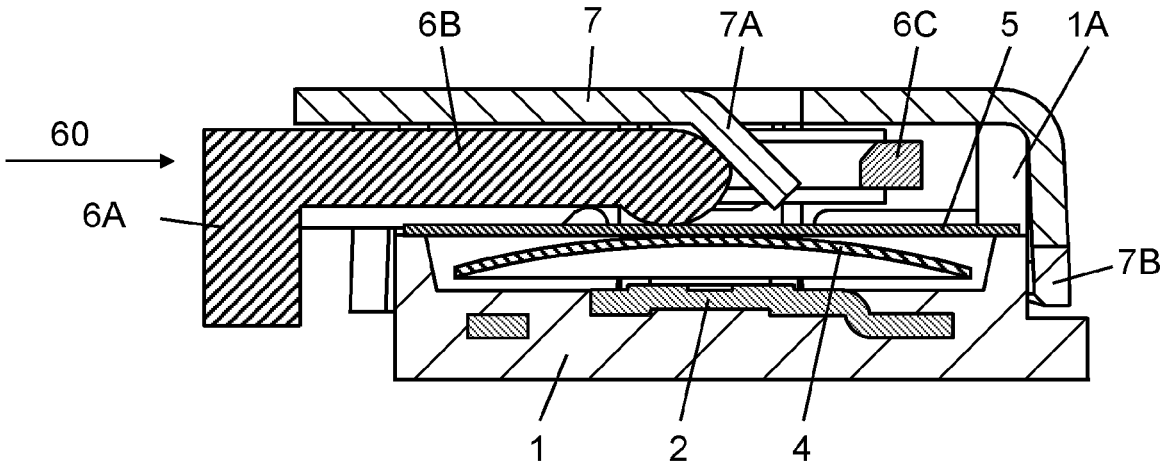
FIG. 12 PRIOR ART
FIG. 12 is a sectional view of the conventional push switch.
Figure 13:
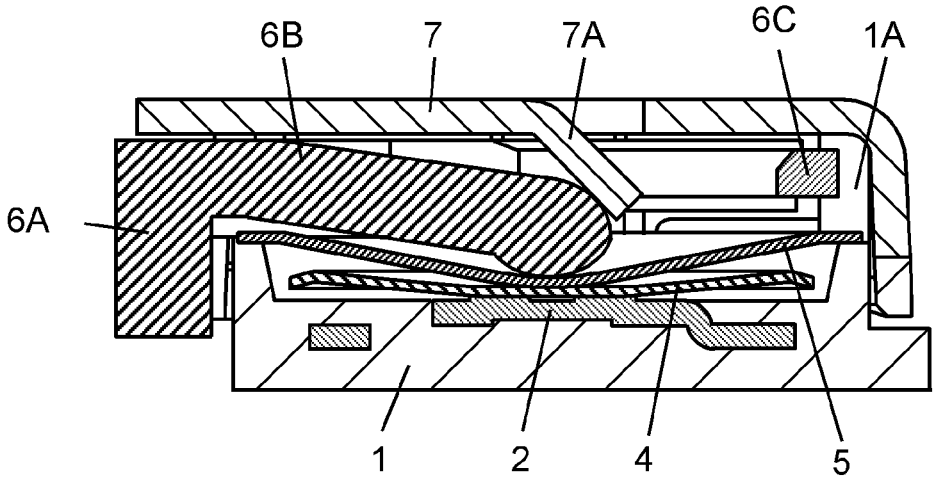
FIG. 13 PRIOR ART
FIG. 13 is a sectional view showing a state in which the conventional push switch operates.
Figure 14:
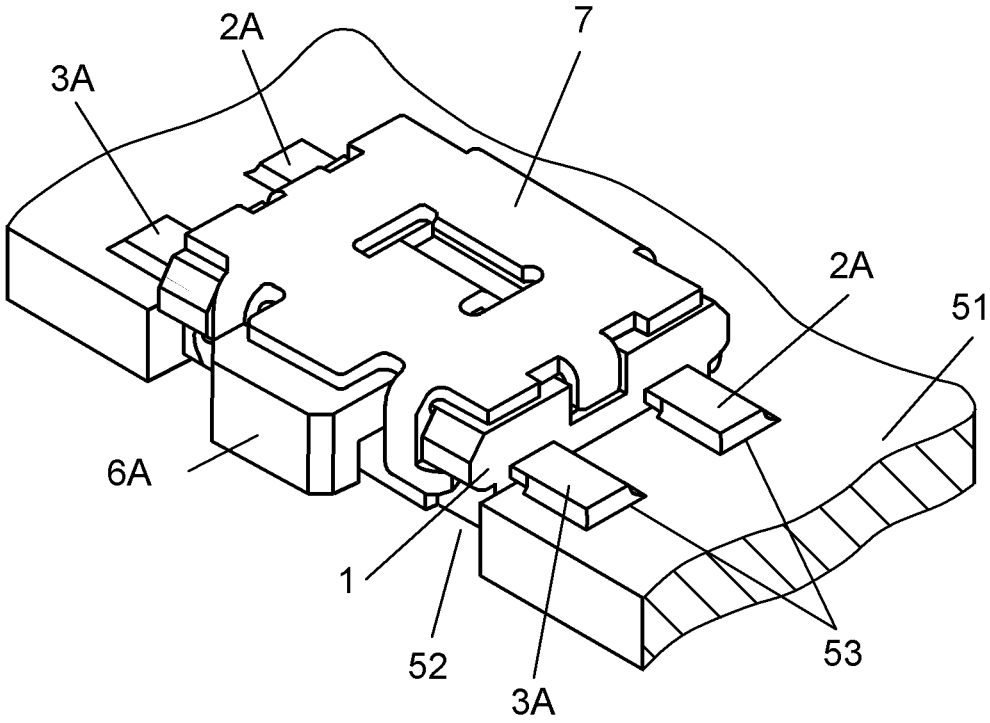
FIG. 14 PRIOR ART
FIG. 14 is an outline view showing a state in which the conventional push switch is mounted on a printed circuit board.

FIG. 8 is an outline view of another push switch seen obliquely from below in accordance with an embodiment of the present invention. FIG. 8 is the same as FIG. 3 except for groove portion 22 provided in switch case 21. Groove portions 22 provided on switch case 21 are provided linearly from root portions at the lower surface side of terminals 12A and 13A led out from the position in the middle of the side surface of switch case 21 to the back surface of switch case 21 (the surface opposite to the opening portion). In addition, recess 21A is formed on the end of groove portion 22.

Recess 21A is a flux reservoir of flux that has traveled along groove portion 22. Even when the amount of flux that has traveled along groove portion 22 is large, the flux can be accumulated in recess 21A. Therefore, since the flux does not spread to operation body 16, the flux does not hinder the operation of the switch.

Note here that in this embodiment, recess 21A is provided on the back surface of switch case 21, but it may be provided on the side surface of switch case 21.

In the above description, a push switch to be operated in the horizontal direction parallel to the top surface of mounted printed circuit board 151, but a push switch to be operated from the direction perpendicular to the top surface of printed circuit board 151 may be employed. In this case, any switch sections may be employed as long as they are capable of electric connection by pushing. That is to say, any push switches may be employed, which include a switch section capable of electric connection by pushing, a switch case having a groove portion on the side surface thereof and accommodating the switch section, and a terminal produced integrally with the switch case and protruding from the side surface of the switch case, and in which the groove portion extends from the vicinity of the terminal.

A push switch of the present invention does not hinder the operation of the switch even when flux travels to the switch case at the time of solder mounting. Therefore, the push switch is useful for an input operation section and the like of various electronic apparatuses.

What is claimed is:

1. A push switch configured to be mounted on a printed circuit board, the push switch comprising:

a switch section for carrying out electric connection by pushing;

a switch case having a groove portion on a side surface thereof and accommodating the switch section; and a terminal produced integrally with the switch case and led out from the side surface of the switch case between a top surface of the switch case and a bottom surface of the switch case, wherein the terminal extends in a first direction along a surface of the printed circuit board when the push switch is mounted thereon, and the groove portion extends in a second direction toward the bottom surface of the switch case under the terminal.

2. The push switch of claim 1, wherein the switch case has an opening portion, and the groove portion extends to a surface opposite to the opening portion of the switch case.

3. The push switch of claim 1, wherein a recess is provided at an end of the groove portion.

4. The push switch of claim 1, wherein the first direction is perpendicular to the second direction.

5. The push switch of claim 1, wherein a width of the groove portion is smaller than a width of the terminal.

6. The push switch of claim 1, wherein a top of the groove portion nearest o the terminal is adjacent to the terminal.

7. The push switch of claim 1, wherein a top of the groove portion nearest to the terminal is offset from the terminal.

* * * * *